US007270517B2

(12) United States Patent
Garner

(10) Patent No.: US 7,270,517 B2
(45) Date of Patent: Sep. 18, 2007

(54) TURBINE BLADE WITH VIBRATION DAMPER

(75) Inventor: Chad M. Garner, Orlando, FL (US)

(73) Assignee: Siemens Power Generation, Inc., Orlando, FL (US)

( * ) Notice: Subject to any disclaimer, the term of this patent is extended or adjusted under 35 U.S.C. 154(b) by 120 days.

(21) Appl. No.: 11/244,752

(22) Filed: Oct. 6, 2005

(65) Prior Publication Data

US 2007/0081894 A1 Apr. 12, 2007

(51) Int. Cl.
*B63H 5/16* (2006.01)
*F01D 5/10* (2006.01)

(52) U.S. Cl. ..... 416/145; 415/115; 415/119; 416/96 A; 416/500

(58) Field of Classification Search ..... 416/145, 416/500, 96 A; 415/115, 119
See application file for complete search history.

(56) References Cited

U.S. PATENT DOCUMENTS 1,833,754 A * 11/1931 Paget ..... 416/215
2,144,428 A * 1/1939 Martin ..... 416/134 R
2,460,351 A 2/1949 Hoffman et al.
2,828,941 A 4/1958 Foley
3,027,138 A * 3/1962 Howell et al. ..... 416/220 R
4,162,136 A 7/1979 Parkes
4,188,171 A 2/1980 Baskin
4,329,119 A 5/1982 Baskin
4,437,810 A 3/1984 Pearce
4,441,859 A 4/1984 Sadler
4,484,859 A 11/1984 Pask et al.
5,165,860 A 11/1992 Stoner et al.
5,205,714 A * 4/1993 Shah et al. ..... 416/220 R
5,232,344 A 8/1993 El-Aini
5,709,527 A 1/1998 Ernst et al.
5,749,705 A 5/1998 Clarke et al.
5,820,343 A 10/1998 Kraft et al.
5,820,346 A 10/1998 Young et al.
5,924,845 A 7/1999 Bagley et al.
6,059,533 A 5/2000 Stoker et al.
6,155,789 A 12/2000 Mannava et al.
6,193,465 B1 2/2001 Liotta et al.
6,224,341 B1 5/2001 Fricke
6,283,707 B1 9/2001 Chin
6,299,410 B1 10/2001 Hilbert et al.
6,354,803 B1 3/2002 Grover et al.
6,371,727 B1 4/2002 Strangeland et al.
6,413,050 B1 7/2002 Shimovetz
6,450,769 B2 9/2002 Szwedowicz
6,478,544 B2 11/2002 Brandl et al.

(Continued)

*Primary Examiner*—Igor Kershteyn

(57) ABSTRACT

A blade assembly (10) for a turbine (16) including a vibration damper (12) having a mounting base (38) sealingly disposed at an inlet end (24) of a cooling fluid passageway (22) within the root section (20) of the blade assembly and including an opening (40) in the mounting base for passing cooling fluid into the cooling passageway. The opening is sized to function effectively as an orifice for limiting a maximum flow rate of cooling fluid in the event of a breach of the cooling fluid passageway downstream of the inlet end. A wear feature (34) is formed on the distal end of the vibration damper opposed the mounting base for rubbing interface with a complementary wear feature attached to a wall (26) of the cooling fluid passageway. The wear feature may include a non-planar wear surface such as angularly disposed wear surfaces (58, 60) effective to resist vibrational movement in two directions.

17 Claims, 3 Drawing Sheets

U.S. PATENT DOCUMENTS

| | | | |
|---|---|---|---|
| 6,503,053 | B2 | 1/2003 | Huebner |
| 6,514,040 | B2 | 2/2003 | Lewis et al. |
| 6,547,526 | B2 | 4/2003 | Van Daam et al. |
| 6,607,359 | B2 | 8/2003 | von Flotow |
| 6,659,725 | B2 | 12/2003 | Yeo et al. |
| 6,676,380 | B2 | 1/2004 | Davis et al. |
| 6,685,435 | B2 | 2/2004 | Davis et al. |
| 6,688,439 | B2 | 2/2004 | Bhattacharya et al. |
| 6,752,594 | B2 | 6/2004 | Miller et al. |
| 6,796,408 | B2 | 9/2004 | Sherwin et al. |

* cited by examiner

TURBINE BLADE WITH VIBRATION DAMPER

FIELD OF THE INVENTION

This invention relates generally to the field of turbomachinery, and more particularly to the field of vibration damping in a rotating airfoil of a turbine.

BACKGROUND OF THE INVENTION

It is well known that the rotating blades of turbo-machinery such as gas turbine engines may be excited into undesirable modes and magnitudes of vibration by forces exerted on the blade during operation of the machine. Left unchecked, such vibration can cause a blade to fatigue prematurely or even to fail catastrophically.

U.S. Pat. No. 5,820,343 describes an airfoil vibration-damping device that attaches to the airfoil platform and extends into a cooling air passage along a radial length of the airfoil. The damping device includes a plurality of bearing surfaces that make contact with the walls of the cooling air passage to dampen vibration of the airfoil during operation of the turbine in which the airfoil is used.

BRIEF DESCRIPTION OF THE DRAWINGS

The invention is explained in following description in view of the drawings that show.

DETAILED DESCRIPTION OF THE INVENTION

Figure 1:
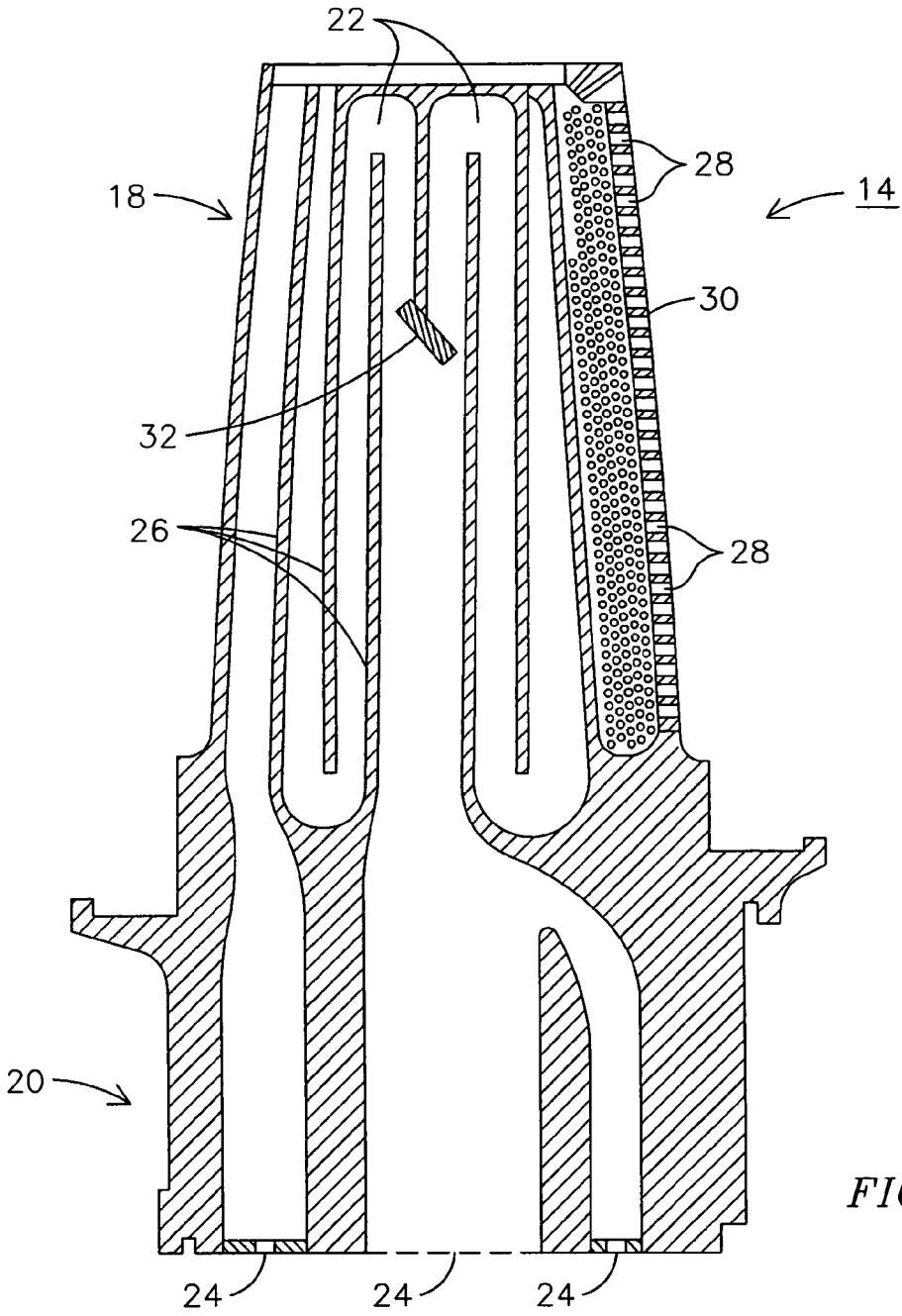
FIG. 1 is a partial cross-sectional view of a blade of a gas turbine engine.
Figure 2:
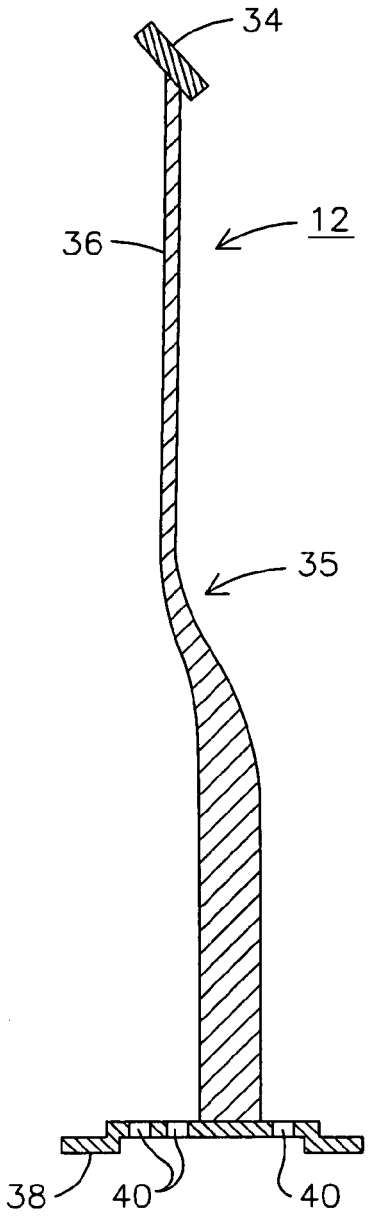
FIG. 2 is a cross-sectional view of a vibration damper adapted for use with the blade of FIG. 1.
Figure 3:
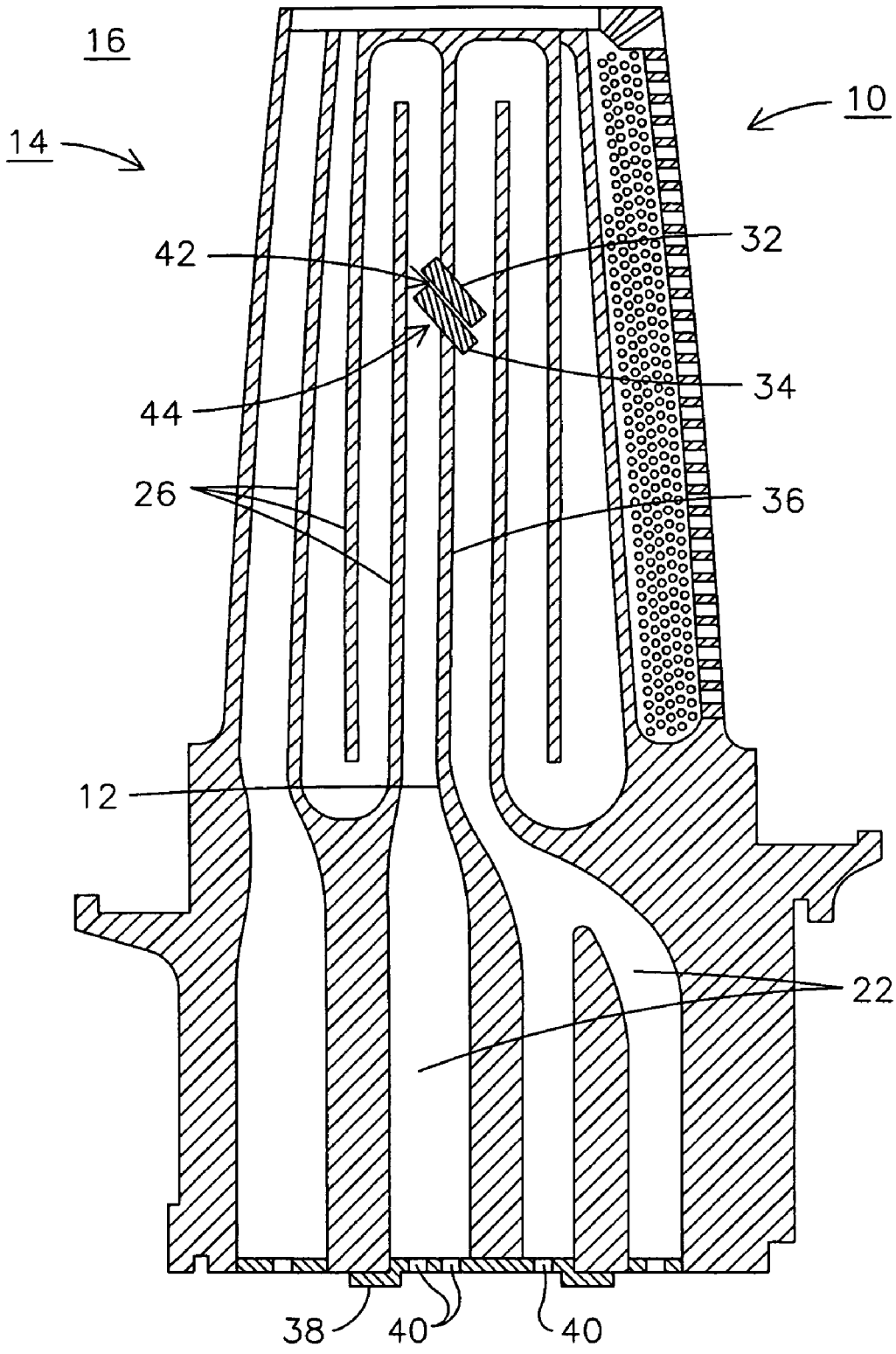
FIG. 3 is a cross-sectional view of a blade assembly including the vibration damper of FIG. 2 installed into the blade of FIG. 1.

The blade assembly 10 of FIG. 3 is formed by installing the vibration damper 12 of FIG. 2 into the blade 14 of FIG. 1. The blade assembly 10 may form part of a turbo-machine such as a gas turbine engine 16.

Referring now to FIG. 1, the blade 14 includes an airfoil section 18 extending radially outwardly from and supported by a root section 20. The root section 20 is shaped to engage a rotating disk (not shown) of the gas turbine engine 16. A fir tree configuration is commonly known and may be used in this embodiment. A plurality of such rotor blades is circumferentially disposed around the disk for rotation about a rotational centerline within the gas turbine engine 16. The blade 14 includes a plurality of cooling fluid passages 22 formed through the blade's interior. The cooling fluid passages 22 include respective inlet ends 24 for receiving a cooling fluid such as compressed air bled from the compressor (not shown) of the gas turbine engine 16. The passages 22 defined by respective walls 26 direct the cooling fluid through the blade interior in order to remove heat energy and to cool the blade material. Thus-heated cooling fluid is then exhausted into the hot combustion gas passing over the exterior of the blade 14 through outlet openings 28 such as illustrated along the blade trailing edge 30. In other embodiments, the heated cooling fluid may be exhausted from the blade through the root without entering the hot combustion gas path.

A wear feature, such as wear pad 32, is attached to the airfoil section 18 interior to the blade 14. In the illustrated embodiment, the wear pad 32 is cast as an extension of one of the interior walls 26. The wear pad 32 is designed for rubbing contact with an associated wear feature, such as wear pad 34 of damper 12 as illustrated in FIG. 2. Damper 12 includes an arm 36 having wear pad 34 at one end and a mounting base 38 at an opposed end. Damper 12 is shaped for installation through one of the inlet ends 24 of one of the cooling passages 22 of blade 14, as illustrated in an installed position in FIG. 3. The damper 12 may be formed of any appropriate material, for example a superalloy metal such as is know for use in manufacturing gas turbine blades. The mounting base may be attached to the blade root section by welding, brazing, bolting or other appropriate connecting method. The damper 12 extends along a radial length of the cooling passage 22 preferably without making contact with the walls 26. The damper 12 may function as a flow-directing member within the cooling fluid passageway 22.

Figure 4:
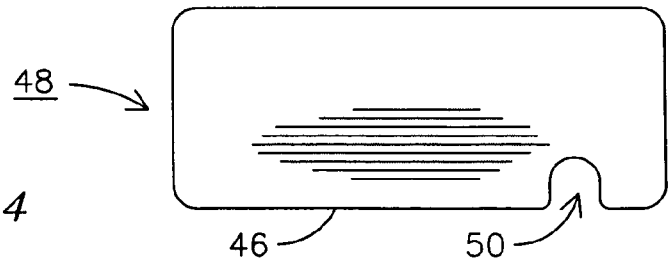
FIG. 4 is a bottom view of a damper mounting base.

Prior art U.S. Pat. No. 5,820,343 purposefully avoids the installation of a vibration damper through the airfoil cooling passage inlets by supporting the damper on the platform of the turbine blade. However, the present inventor has recognized a disadvantage of supporting the damper from the platform because of the high level of stress that is generated in the platform during operation of the turbine as a result of the centrifugal forces acting upon the weight of the damper. The present inventor has also recognized a need to provide a flow limiting orifice in certain blade cooling passages in order to limit the maximum cooling fluid flow rate that may occur in the event of a major breach in the cooling passage pressure boundary. The present inventor has advantageously solved both of these problems by using the mounting base 38 as both a support for the damper 12 and as an orifice plate for choking the flow of cooling fluid through the inlet end 24 of the cooling passage 22. The mounting plate 38 may be formed and installed, such as by welding, effectively to seal the inlet end 24 with the exception of one or more openings 40 that function as flow limiting orifices. In this manner the centrifugal forces acting on the damper 12 may be supported directly by the root section 20 of the blade 14, thereby reducing stress levels within the blade assembly 10 and reducing the required strength (and therefore size and weight) of portions of the blade 14. The openings 40 are sized to control a cooling fluid flow by allowing a desired flow rate of cooling fluid during normal operation while at the same time providing effective flow resistance to limit the cooling fluid flow rate in the event of an off-design breach of a cooling passage pressure boundary such as may be caused by impact damage to the blade assembly 10. The openings are illustrated in FIGS. 2 and 3 as holes 40 formed in the mounting plate 38 remote from an edge of the plate. In other embodiments, an opening may be formed along an edge 46 of a mounting base 48, such as in the form of a notch 50 as illustrated in FIG. 4, so that the mounting base 48 functions to seal the inlet end 24 with the exception of along the edge 46 of the base. Any combination of opening shapes and locations may be used as required to provide the desired flow-control function.

As shown in FIG. 3, there may be a slight gap 42 between the opposed wear pads 32, 34 when the blade assembly 10 is assembled at cold static conditions. However, during operation of the gas turbine engine 16 in which such an assembly 10 is used, the gap 42 will close due to centrifugal forces acting on the damper 12 causing it to deform until the opposed wear pads 32, 34 make contact. In the embodiment of FIG. 2, the centrifugal forces may tend to straighten the curved portion 35 of arm 36, thereby increasing an overall length of the damper 12 and causing the contact pad 34 to move away from the mounting base 38 to make contact with wear pad 32. Contact between the wear pads 32, 34 functions to absorb vibration energy in the blade assembly 10. The rubbing surfaces of the wear pads 32, 34 may be coated with an appropriate hard-facing material as may be known in the art to limit material damage due to rubbing.

During operation of the gas turbine engine 16, a turbine blade may experience vibration in several different modes: chord-wise vibration; easy-wise vibration (perpendicular to the blade chord); torsional vibration; and breathing mode vibration (expansion and contraction of the volume of the blade). A finite element model or other type of analysis tool may be used to predict the movement of various points on the blade 14. The location of the wear pads 32, 34 advantageously may be selected to limit the displacement of a point 44 on the blade 14 that would otherwise experience a maximum displacement due to operation-induced vibration without the action of the damper 12. For example, if the blade 14 is predicted to experience an easy-wise mode of vibration that results in a sinusoidal displacement in the blade having a maximum displacement at a particular radial position (i.e. along the blade length perpendicular to the rotational centerline), then the wear pads 32, 34 may be located at that particular radial position. The wear pads 32, 34 are oriented at that radial location so that wear pad 32 is forced into wear pad 34 by the vibrational motion of the blade 14 with sliding contact between the faces of the rubbing wear pads. Reaction forces between the wear pads 32, 33 will limit the maximum displacement in the blade 14 and vibration energy will be absorbed in the process, thus resulting in a lowered peak stress within the blade assembly 10.

Figure 5:
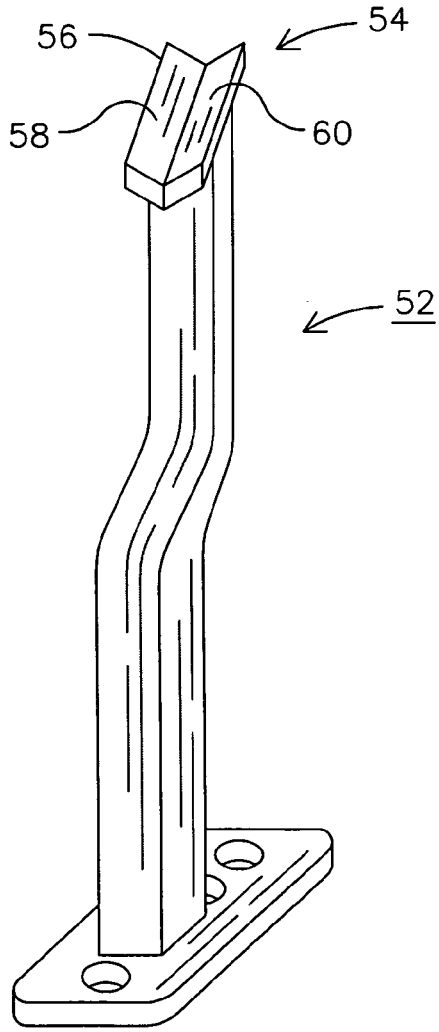
FIG. 5 is a perspective view of a vibration damper having a V-shaped wear feature.

The shape, size and/or orientation of the wear pad surfaces may be selected to optimize the absorption of vibration energy and/or to minimize material wear on the pads. The embodiment illustrated in FIGS. 1-3 utilizes a single pair of wear pads 32, 34; however, in other embodiments more than one pair of associated wear pads may be used to limit the movement within the blade assembly 10. Furthermore, a wear feature may include a non-planar wear surface or more than one wear surface. In the embodiment of the vibration damper 52 of FIG. 5, the wear feature 54 includes a V-shaped member 56 having a non-planar wear surface including two angularly disposed surfaces 58, 60. A complementary shape would be formed on a mating wear feature attached to the airfoil section of the blade (not shown). The angle formed by the V-shape may be 90 degrees or other angle appropriate to accommodate the relative motion between the rubbing wear surfaces. This type of wear feature may be useful for embodiments wherein it is desired to limit vibrational movement along two different axes; such as for example in both the chord-wise and easy-wise directions. The orientation of the wear surface(s) may also be rotated about a radial axis to any desired position to accommodate a mode of vibration. Other embodiments of non-planar wear feature wear surfaces may include complementary curvilinear surfaces.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A turbine blade assembly comprising:

a root section;

an airfoil section extending from and supported by the root section;

a cooling fluid passageway comprising an inlet end disposed in the root section and extending through an interior of the airfoil section;

a first wear feature disposed in the cooling fluid passageway and attached to the interior of the airfoil section;

a damper comprising a mounting base, an arm attached to and extending from the mounting base, and a second wear feature attached to the arm;

the damper mounting base affixed at the cooling fluid passageway inlet end so that the arm extends into the passageway to position the second wear feature proximate the first wear feature; and at least one opening in the mounting base for passing a flow of cooling fluid into the cooling fluid passageway and effective to function as a flow limiting orifice in the event of an off-design breach of the cooling fluid passageway downstream of the inlet end.

2. The turbine blade assembly of claim 1, wherein the first and second wear features are disposed at a radial position along the airfoil such that interaction of the first and second wear features is effective to limit displacement of a point of the blade subject to a highest vibrational displacement.

3. The turbine blade assembly of claim 1, wherein the first wear feature is disposed at a position within the airfoil section that would be exposed to maximum vibrational displacement without action of the damper during use of the turbine blade assembly in a turbo-machine.

4. The turbine blade of claim 1, wherein the opening comprises a hole formed in the mounting base.

5. The turbine blade of claim 1, wherein the opening comprises a notch formed along an edge of the mounting base.

6. The turbine blade of claim 1, further comprising:

a gap separating the first and second wear features during a static condition;

a curved portion of the arm subjected to a straightening effect due to a centrifugal force imposed on the damper during use of the turbine blade assembly in a turbo-machine, the straightening effect eliminating the gap and causing the first and second wear features to come into contact.

7. The turbine blade of claim 1, wherein each of the first and second wear features comprise a non-planar wear surface.

8. The turbine blade of claim 7, wherein the non-planar wear surface comprises a V-shape comprising two angularly disposed surfaces.

9. A gas turbine engine comprising the turbine blade of claim 1.

10. A vibration damper for a turbo-machine comprising:

a mounting base;

an arm supported by and extending from the mounting base and shaped to extend within a cooling fluid passageway of an airfoil;

a wear feature attached to the arm opposed the mounting base;

an opening formed in the mounting base and sized to control a cooling fluid flow into the cooling fluid passageway.

11. The vibration damper of claim 10, wherein the arm comprises a length necessary to position the wear feature proximate a point of maximum vibrational displacement predicted for the airfoil during operation of the turbo-machine.

12. The vibration damper of claim 10, wherein the opening comprises a hole formed through the mounting base.

13. The vibration damper of claim 10, wherein the opening comprises a notch formed along an edge of the mounting base.

14. The vibration damper of claim 10, wherein the arm comprises a curved portion subjected to a straightening effect due to a centrifugal force imposed on the vibration damper during operation of the turbo-machine.

15. The vibration damper of claim 10, wherein the wear feature comprises a non-planar wear surface.

16. The vibration damper of claim 15, wherein the non-planar wear surface comprises a V-shape comprising two angularly disposed surfaces.

17. A gas turbine engine blade assembly comprising the vibration damper of claim 10.

* * * * *